United States Patent [19]

Morikawa et al.

[11] 3,974,635

[45] Aug. 17, 1976

[54] FEED ROLLER FOR FEEDING FIBERS TO A COMBING ROLLER IN AN OPEN END SPINNING MACHINE

[75] Inventors: Takashi Morikawa, Amagasaki; Hidetoshi Kihara, Hirakata; Tohru Urifu, Itami; Hisateru Takahashi, Fukui, all of Japan

[73] Assignees: Daiwa Boseki Kabushiki Kaisha, Osaka; Kabushiki Kaisha Toyoda Jidoshokki Seisakusho, Kariya, both of Japan

[22] Filed: July 12, 1974

[21] Appl. No.: 488,197

[30] Foreign Application Priority Data

Sept. 3, 1973 Japan ..... 48-103681[U]

[52] U.S. Cl. ..... 57/58.95

[51] Int. Cl.[2] ..... D01H 1/12; D01H 13/02

[58] Field of Search ..... 57/1 R, 34 R, 58.89–58.95, 57/90, 106; 19/105

[56] References Cited

UNITED STATES PATENTS

| | | | |
|---|---|---|---|
| 3,360,918 | 1/1968 | Doublebsky et al. | 57/58.95 |
| 3,439,488 | 4/1969 | Bucil et al. | 57/58.95 |
| 3,487,626 | 1/1970 | Rajnoha et al. | 57/58.95 X |
| 3,571,859 | 3/1971 | Doublebsky et al. | 57/58.95 X |
| 3,626,685 | 12/1971 | Constantakis | 57/90 X |
| 3,695,022 | 10/1972 | Landwehrkamp | 57/58.95 X |
| 3,826,071 | 7/1974 | Grau | 57/58.95 X |
| 3,828,539 | 8/1974 | Croasdale | 57/58.95 X |
| 3,834,145 | 9/1974 | Ellingham | 57/58.95 X |

FOREIGN PATENTS OR APPLICATIONS

| | | | |
|---|---|---|---|
| 702,713 | 1/1954 | United Kingdom | 57/58.95 |

*Primary Examiner*—Donald E. Watkins

*Attorney, Agent, or Firm*—Wenderoth, Lind & Ponack

[57] ABSTRACT

A feed roller for feeding fibers to a combing roller in an open end spinning machine. The feed roller has a plurality of circumferential grooves in the peripherial surface thereof. The grooves can extend perpendicularly to the longitudinal axis of the feed roller, or can be slightly inclined relative to a plane perpendicular to the longitudinal axis of the feed roller.

2 Claims, 7 Drawing Figures

FEED ROLLER FOR FEEDING FIBERS TO A COMBING ROLLER IN AN OPEN END SPINNING MACHINE

The present invention relates to a feed roller for feeding fibers to a combing roller in an open end spinning machine.

The feed roller heretofore used in the open end spinning machine is provided, on its peripheral surface, with a plurality of grooves extending parallel with the axis of rotation of the feed roller.

With the feed roller having such a construction, however, since the direction of the grooves in the peripheral surface of the feed roller is substantially at right angles relative to the direction of fibers being fed, the grip action on the fibers by the ridges between the grooves is so strong that even if the fibers are relatively short, some of the fibers are broken by the combing-points on the peripheral surface of the combing roller which is rotated at high speed. Yet it is not desirable to decrease the pressure of the spring urging the presser against the feed roller, since this entails the disadvantage that the fibers tend to be ineffectually pulled out from between the feed roller and the presser as bundles causing unevenness and breakage of the spun yarn.

Furthermore, when a feed roller of the construction as described above is used for feeding long staple fibers (the term long staple fibers as used herein means fibers with staple length of above about 50 mm.) comprising natural fibers and synthetic fibers, the said tendency becomes even greater since the long staple fibers are subjected to a greater amount of combing action by the combing-points of the combing roller than in the case wherein the staple fibers are short such as cotton fibers. Still further, since the distance $p$ along the fibers from a fiber gripping point between the feed roller and the presser to the point where the fibers begin to be subjected to the combing action of the combing roller is constant, the longer the average staple fiber length $l$, the longer the distance $(l-p)$ over which the combing action, resulting in greatly increased damage and breakage of the fibers. The broken short fibers cannot be well twisted into a yarn, and, therefore, the strength of the spun yarn is decreased. Furthermore, the longer the average staple fiber length $l$, longer the period of time during which the combing-points act on the individual fiber becomes, and thus the wear of the combing-points is accelerated. This brings about a disadvantage that the life of a combing wire which has the combing-points is shortened and it has to be replaced by a new one at an early stage so that the manufacturing cost of the yarn is increased.

Therefore, it is an object of the present invention to provide a feed roller for use in an open end spinning machine which eliminates the above described disadvantages and enables a single spinning machine to spin various kind of fibers of different staple lengths by changing the feed roller.

A more specific object of the present invention is to provide a feed roller which is capable of exerting a reduced gripping force on the staple fibers without decreasing the pressure of the spring urging the presser against the feed roller.

According to the present invention, there is provided a feed roller for use in an open end spinning machine, which has a plurality of circumferential grooves in its peripheral surface.

The invention will be better understood from the following description taken in connection with the accompanying drawings in which.

Figure 1:
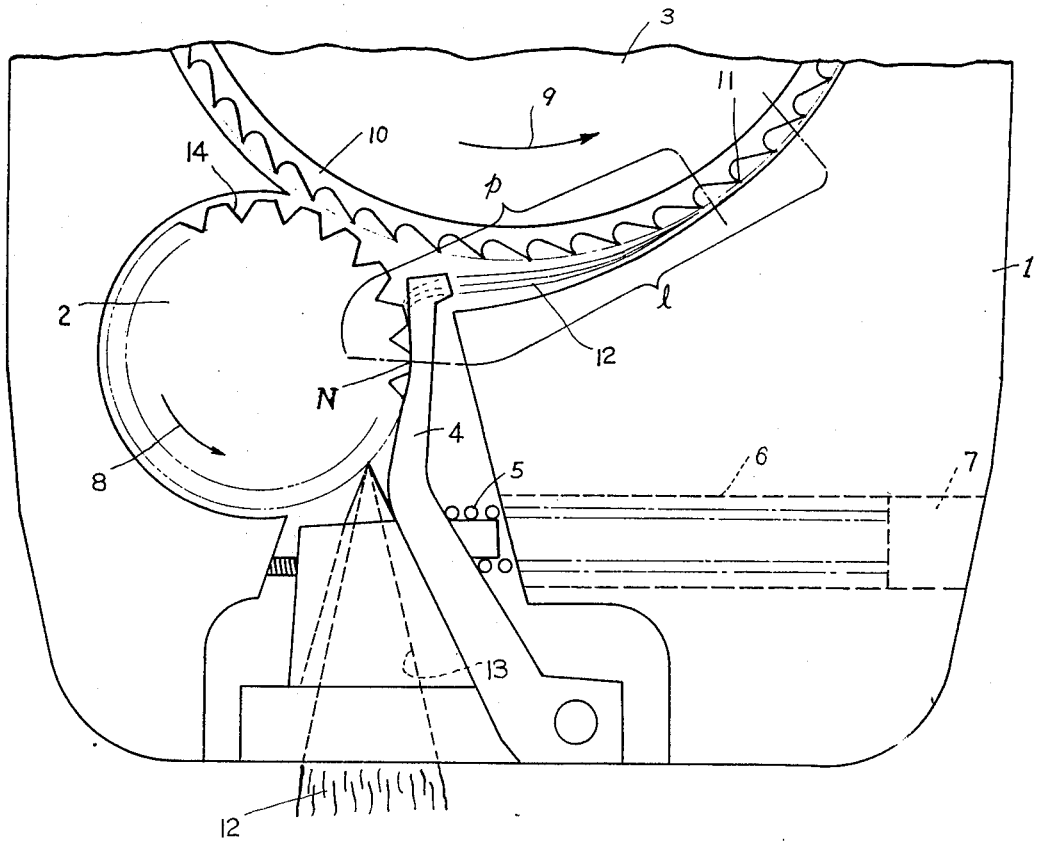
FIG. 1 is an enlarged plan view schematically showing a portion of an open end spinning machine with which the present invention is concerned.

With reference now to the drawing and more particularly to FIG. 1 thereof, there is illustrated a portion of an open end spinning machine comprising a conventional feed roller.

In FIG. 1, the reference numeral 1 designates a body of an open end spinning machine. In the body 1, there is formed a cavity of a suitable shape, and a feed roller 2, combing roller 3 and a presser 4 are arranged in said cavity as shown in FIG. 1. The reference numeral 5 designates a spring which urges the presser 4 against the feed roller 2. The spring 5 is arranged in a bore 6 formed in the body 1 and has its one end held by the presser 4 and the other end connected to an adjusting means 7 by which the pressure exerted by the spring 5 on the presser 4 can be adjusted. The feed roller 2 and the combing roller 3 are rotated in the direction shown by the arrows 8 and 9, respectively. The combing roller 2 has a combing wire 10 wound thereon and having a series of combing-points 11 thereon.

The fibers 12 are drawn into the spinning machine through an inlet channel 13 by means of the feed roller 2 and then fed to the combing roller 3 where the fibers 12 are combed. Such combed fibers are fed into a rotary spinning chamber (not shown in the drawings) where they are spun into a yarn.

In FIG. 1, the character $l$ designates the average staple fiber length, the character N designates the fiber gripping point between the feed roller 2 and the presser 4, and the character $p$ designates the distance along the fibers 12 between said fiber gripping point N and the point where the fibers 12 begin to be subjected to the combing action of the combing roller 3.

Figure 2:
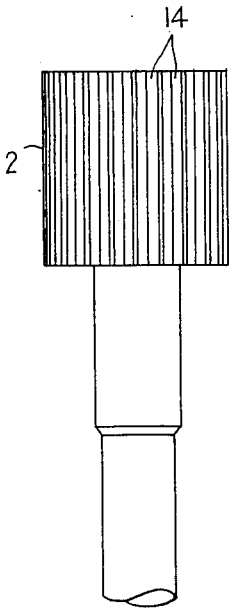
FIG. 2 is a side elevational view showing a conventional feed roller which is used in the open end spinning machine of FIG. 1.

As seen in FIGS. 1 and 2, the conventional feed roller 2 has in its peripheral surface, a plurality of grooves 14 extending parallel with the axis of rotation of the feed roller. Furthermore, it will be seen in FIG. 1 that the direction of the grooves 14 is at right angles relative to the direction of the fiber feeding. This brings about various drawbacks as stated in the introductory part of this specification.

Figure 3:
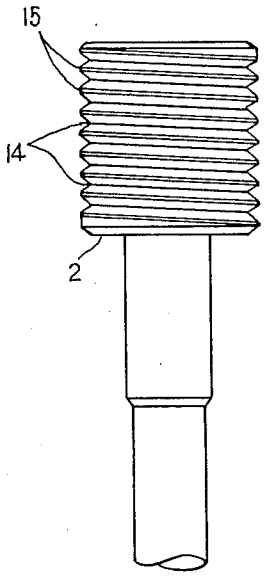
FIG. 3 is a side elevational view showing an embodiment of the feed roller according to the present invention.

Now referring to FIG. 3, there is illustrated an embodiment of the feed roller 2 according to the present invention. As seen in FIG. 3, in the present invention, the feed roller 2 has a plurality of circumferential grooves 14. In this embodiment, the grooves 14 are inclined rightwardly downwardly as viewed in FIG. 3 and are formed as a continuous screw. Since the inclination of the grooves 14 is preferably determined to be opposite to the lead direction of the combing wire 10 on the combing roller 3, the feed roller 2 of FIG. 3 is preferably used in combination with a combing roller the lead of which is inclined rightwardly upwardly. Such opposite direction of the inclinations of the grooves 14 of the feed roller 2 and of the combing wire 10 contributes to preventing the fibers 12 from being deviated toward one side. Thus, if the lead direction of the combing roller 3 is inclined rightwardly downwardly, a feed roller having grooves 14 inclined rightwardly upwardly preferably is used in combination with such combing roller.

Since the feed roller 2 of the present invention has circumferentially extending grooves 14, the fiber gripping action at the fiber gripping point N is considerably weakened as compared with the conventional feed roller, and, therefore, even if the average staple fiber length $l$ is long and hence the distance $(l-p)$ through which the fibers are subjected to the combing action is long, the fibers are pulled out from the fiber gripping point N before the fibers are broken and the tension on the fibers exerted at the combing-points 11 is decreased resulting in decreased wear of the combing-points 11.

In the embodiment of FIG. 3, the top surface of the ridges 15 between any adjacent two grooves 14 is smooth in order to somewhat weaken the fiber gripping action at the fiber gripping point N. Thus, this feed roller is suitable for use in feeding long fibers where the coefficient of friction between metallic material of the feed roller 2 and the fibers 12 is relatively high.

Furthermore, since the grooves 14 are inclined relative to the axis of rotation of the feed roller 2, the fiber gripping point N is continuously moved in the axial direction of the feed roller 2 and the fibers positioned in the grooves 14 are continuously changed as the feed roller 2 is rotated. As a result, only those fibers which are subjected to the combing action by the combing-points 11 are pulled out of the grooves 14 at the fiber gripping N and the pulling-out of the fibers in small groups is prevented, so that the breakage of the fibers 12 and the formation of slubs by the combing wire 10 are greatly decreased. Therefore, a yarn of high quality incorporating the characteristics of the fibers 12 can be spun.

Furthermore, the direction of the grooves 14 is substantially the same as the direction of the fiber feeding and, therefore, the deviation of the fibers toward the axial ends of the feed roller 2 is prevented.

It is preferable to select the inclination of the groove 14 relative to a plane perpendicular to the longitudinal axis (i.e. the axis of rotation) of the feed roller 2 so that it is in the range 0 – 15 angular degrees. If the said inclination of the grooves 14 exceeds about fifteen angular degrees, the said deviation of the fibers toward the axial ends of the feed roller 2 is not well prevented and the fiber gripping force at the fiber gripping point N becomes so great that the breakage of the fibers occurs.

Figure 4:
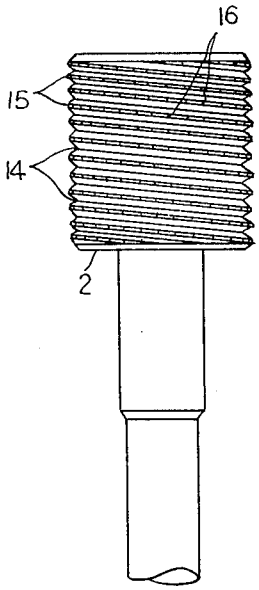
FIG. 4 is a side elevational view showing another embodiment of the feed roller according to the present invention.

Now referring to FIG. 4, there is illustrated another embodiment of the feed roller according to the present invention.

In this embodiment, the grooves 14 are inclined as in the embodiment of FIG. 3. However, the grooves 14 are independent of each other and the top surfaces of the ridges 15 between any two adjacent grooves 14 have shallow flutes or scratches therein as designated by the reference numeral 16. As a result, the fiber gripping action at the fiber gripping point N becomes somewhat greater than in the case of the feed roller 2 shown in FIG. 3, so that it is suitable for use in feeding long fibers where the coefficient of friction between the metallic material of the feed roller 2 and the fibers 12 is relatively low.

Figure 5:
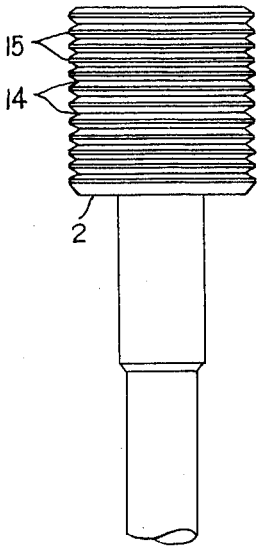
FIG. 5 is a side elevational view showing a further embodiment of the feed roller according to the present invention.
Figure 6:
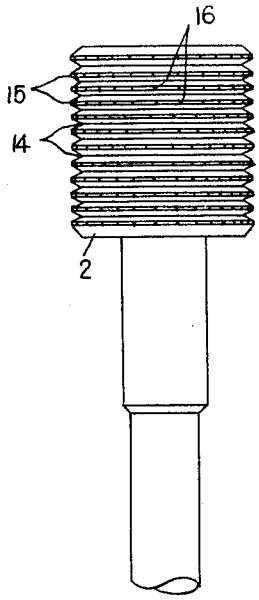
FIG. 6 is a side elevational view showing a still further embodiment of the feed roller according to the present invention.

FIGS. 5 and 6 illustrate further embodiments of the feed roller according to the present invention, wherein the feed roller 2 has a plurality of circumferential grooves 14 which are independent of each other and extend at right angles relative to the longitudinal axial direction of the feed roller 2. The top surfaces of the ridges 15 are smooth in the embodiment of FIG. 5 as in the embodiment of FIG. 3 whereas in the embodiment of FIG. 6 they have flutes or scratches 16 as in the embodiment of FIG. 4.

In the embodiments of FIGS. 5 and 6, the grooves 14 are extending in the general feeding direction of the fibers 12. However, the advantage as obtained by the embodiment of FIGS. 3 and 4 which have been described above are also obtainable by the embodiments of FIGS. 5 and 6 since the individual fibers are not in exactly the same direction as the grooves 14 but are always slightly inclined relative to the grooves 14.

Figure 7:
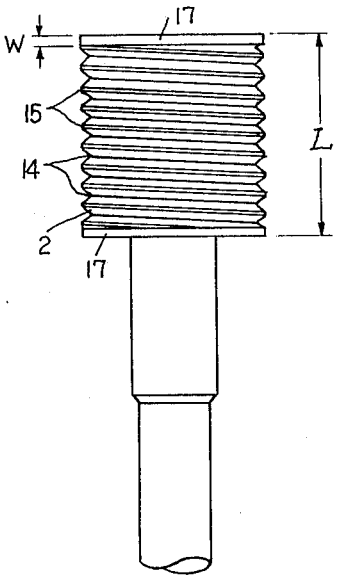
FIG. 7 is a side elevational view showing a still further embodiment of the feed roller according to the present invention.

FIG. 7 shows a still further embodiment of the feed roller according to the present invention.

This embodiment is similar to the one of FIG. 3 except that at least one longitudinal end (both or opposite longitudinal ends in the illustrated embodiment) is left ungrooved as designated by the reference numeral 17. The diameter of such ungrooved portions 17 is same as the diameter of the ridges 15 and the width $w$ of such ungrooved portions 17 is very small as compared with the full length L of the feed roller 2. Such ungrooved portions 17 serve to prevent the fibers being fed from deviating in the longitudinal axial direction of the feed roller 2 beyond its longitudinal ends.

While the principles of the invention have been described above in connection with specific embodiments, and particular modifications thereof, it is to be clearly understood that this description is made only by way of example and not as a limitation on the scope of the invention. For instance, the ungrooved portions as shown in FIG. 7 may be applied to any feed roller according to the present invention. Furthermore, in the embodiment of FIG. 3, the grooves may be formed as two or more continuous screws which are interlaced with each other.

What is claimed is:

1. A feed roller for feeding fibers to a combing roller in an open end spinning machine, said feed roller having a plurality of circumferential grooves in the peripheral surface thereof, at least one longitudinal end of the peripheral surface of the feed roller being ungrooved and the diameter of the ungrooved portion being the same as the diameter of the portions of the roller between any two adjacent grooves.

2. A feed roller as claimed in claim 1, wherein the top surfaces of the portions between any two adjacent grooves have flutes or scratches therein.

* * * * *